US006035685A

United States Patent [19]

Takai et al.

[11] Patent Number: 6,035,685

[45] Date of Patent: Mar. 14, 2000

[54] ROLLING UNIT

[75] Inventors: Yoshikazu Takai, Nagoya; Hideo Kobayashi; Yoshio Kato, both of Aichi; Tatsuya Ishihama, Nagoya, all of Japan; Harold E. Woodrow, Northboro, Mass.

[73] Assignees: Morgan Construction Company, Worcester, Mass.; Daido Steel Co., Ltd., Japan

[21] Appl. No.: 08/380,125

[22] Filed: Jan. 30, 1995

[51] Int. Cl.[7] ..... B21B 31/26

[52] U.S. Cl. ..... 72/235; 72/248

[58] Field of Search ..... 72/234, 235, 248

[56] References Cited

U.S. PATENT DOCUMENTS

| | | | |
|---|---|---|---|
| 4,969,347 | 11/1990 | Matsuo et al. | 72/248 |
| 5,000,023 | 3/1991 | Feldmann et al. | 72/235 |

FOREIGN PATENT DOCUMENTS

| | | | |
|---|---|---|---|
| 0340505 | 11/1989 | European Pat. Off. . | |
| 55-103204 | 8/1980 | Japan | 72/235 |
| 55-122623 | 9/1980 | Japan | 72/235 |
| 61-150703 | 7/1986 | Japan . | |
| 62-068609 | 3/1987 | Japan . | |

OTHER PUBLICATIONS

Stahl Und Eisen., vol. 110, No. 6, Jun. 14, 1990, pp. 59–64, W. Kramer et al., Hochpräzisionswalzen von Stabstahl auf der Feinstahl– und Drahtsrasse der von Moos Stahl AG.

Iron and Steel Engineer, vol. 55, Jan. 1978, pp. 55–67, H. Brauer et al., "Developments–Rolling mill blocks in modern Kocks mills".

*Primary Examiner*—Joseph J. Hail, III

*Attorney, Agent, or Firm*—Samuels, Gauthier & Stevens

[57] ABSTRACT

Disclosed is a rolling unit (10) consisting of two roll stands (12, 14). The roll stands (12, 14) each have pairs of openings (24*a*) defined through a housing (24) to locate on each side of the pass line (PL), and a pair of eccentric members (26) each having an eccentric opening (26*a*) are rotatably inserted in these openings (24*a*), respectively, with a predetermined space being secured axially therebetween. A pair of roll shafts (28), on which rolls (13, 15) are fitted to be rotatable integrally therewith, respectively, are rotatably inserted through these eccentric openings (26*a*). A pair of adjusting shafts (32) are rotatably disposed in the housing (24). A pair of worms (34), which engage with toothed portions (26*b*) are fitted on each adjusting shaft (32) to be rotatable integrally therewith. A gear, which is engaged commonly with the adjusting shaft (32). The positions of the rolls (13) can be varied by rotating the adjusting gear via the eccentric members (26).

1 Claim, 7 Drawing Sheets

ROLLING UNIT

BACKGROUND OF THE INVENTION

This invention relates to a rolling unit having at least two successive roll stands for rolling products such as steel bars or wire rods, in which the axis-to-axis distance between the rolls in one roll stand and those of the other roll stand is shortened so as to eliminate the need for interstand guides.

Rolling mills are known in which a plurality of roll stands are serially arranged along a pass line, and the product is rolled to a predetermined size by passing it through these roll stands. Each roll stand is equipped with a pair of rolls disposed rotatably in a housing, and the product is passed through a roll pass defined by grooves in the rolls. In the roughing and intermediate sections of the mill, the pass sequence can be "oval-round" in which oval and round roll passes are alternately disposed sequentially. Alternatively, the pass sequences can be "rhombic-square" in which rhombic and square roll passes are alternately disposed sequentially. In the finishing section of the mill, however, an oval-round pass sequence is usually employed to deliver a round product from the mill.

In the oval-round pass sequence, a roller guide is disposed at the inlet side of each round pass, so that the product can be fed in a proper orientation into the round pass and thus can be accurately rolled. In the rhombic-square pass sequence, a similar guide is also disposed at the inlet side of each square pass so as to optimize area reductions.

In the rolling mill described above, a roll parting adjustment device must inevitably be employed for adjusting the clearance or "parting" between the roll pairs so as to adjust the cross-sectional dimensions of the product passing therebetween. The roll parting adjustment device is designed to move one roll closer to or farther from the other roll, the latter roll being fixed at a predetermined position.

When the parting between the rolls is adjusted, the position of the associated roller guide disposed in the rolling unit must be adjusted correspondingly, causing an attendant loss of valuable production time. Further, since misguiding of the product by the roller guide leads to defects, maintenance of guide bearings, checking of surface flaws on the guide rollers, checking of the rolling state of the rollers, etc. must frequently be carried out. It can also be pointed out that the roller guides disposed between the respective roll stands make the structure of the rolling equipment more complicated and costly.

In such rolling mills, since housing posts for supporting the roll parting adjustment mechanisms are located on the inlet side and outlet side, the distance between the upstream roll stand and the downstream roll stand increases by the thickness of the posts. Additionally, the roller guides disposed between the roll stands also take up space, with the result that the overall length of the installation is disadvantageously increased.

A general objective of the present invention is to avoid or at least substantially mitigate the problems noted above by achieving a significant reduction in the distance between roll stands in a rolling mill.

A companion objective of the present invention is to eliminate the need for interstand guides, thereby substantially simplifying the task of adjusting the mill to accommodate different product sizes.

SUMMARY OF THE INVENTION

In order to overcome the above problems and attain the intended objects successfully, the rolling unit according to this invention consists of two roll stands, which are arranged in such a way that the rotational axes of the rolls in one roll stand are offset with respect to those of the rolls in the other roll stand by an angle of 90°, and the axis-to-axis distance between the rolls in the former and the rolls in the latter is not more than 1.2 times the diameter of these rolls.

Since the axis-to-axis distance between the rolls in one roll stand and the rolls in the other roll stand, which are arranged sequentially, is set to be not more than 1.2 times the diameter of these rolls, twisting of the product during the rolling process can effectively be prevented without having to resort to the use of interstand guides. As a consequence, the overall design of the rolling unit is simplified, with attendant reductions in capital investment. Furthermore, occurrence of defective products attributable to improper guide settings can be eliminated, and the intricate guide checking and maintenance operations also can be avoided. Since the rolling unit can be downsized, the entire length of the installation is reduced, enabling efficient utilization of plant space.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF THE INVENTION

Figure 2:
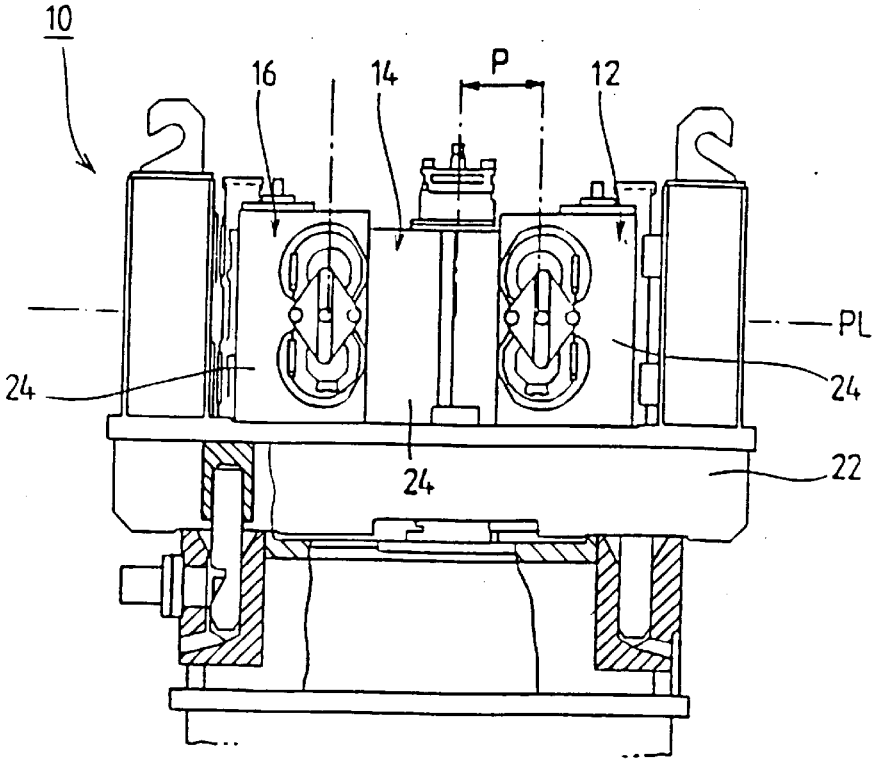
FIG. 2 shows a partially cut-away front view of the rolling unit according to the preferred embodiment of the invention.
Figure 3:
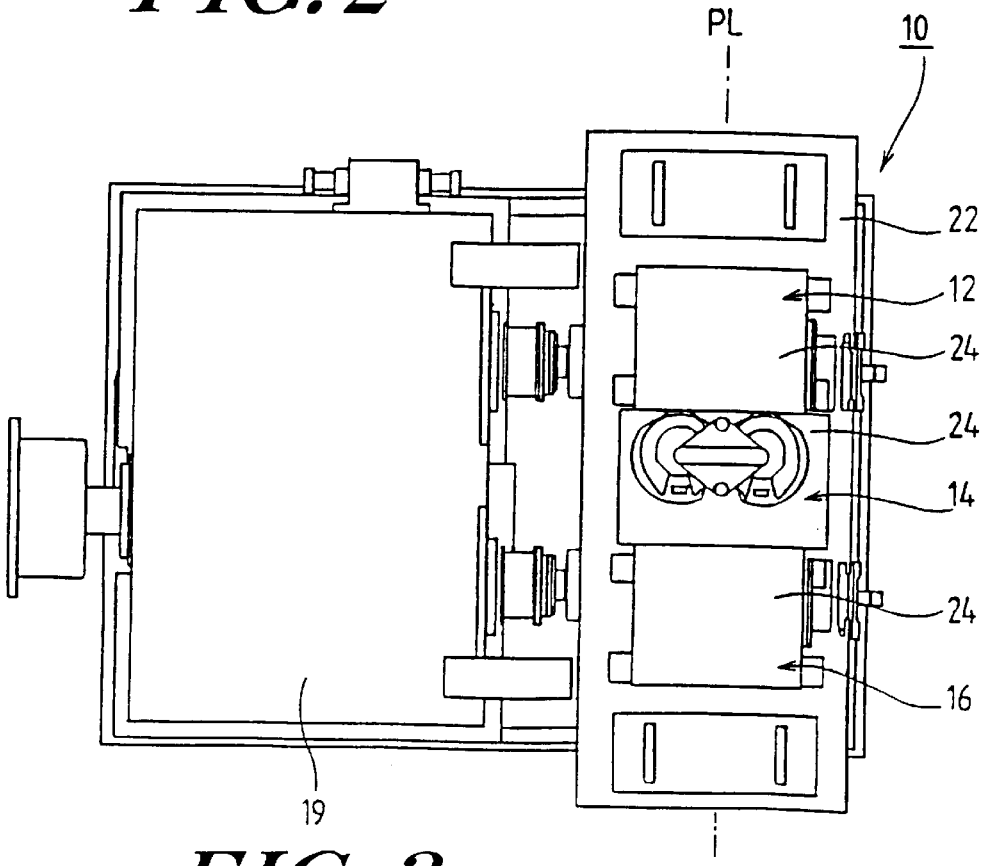
FIG. 3 shows a plan view of the rolling unit according to the preferred embodiment of the invention.
Figure 7:
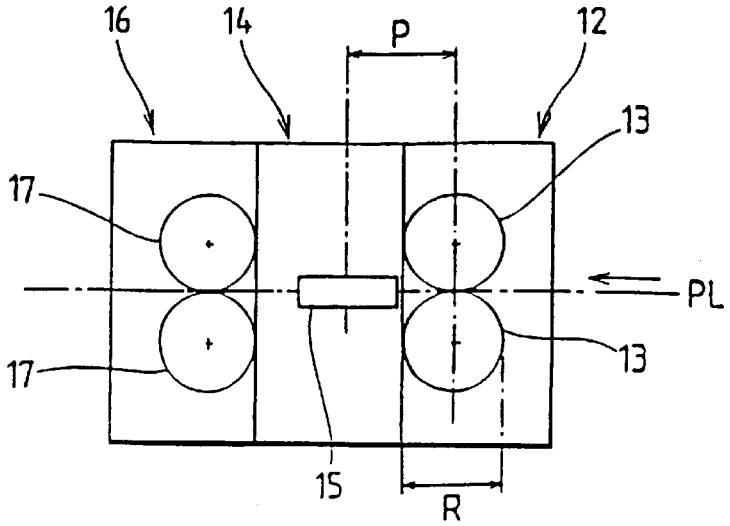
FIG. 7 shows in explanatory view the arrangement of rolls in each roll stand of the rolling unit according to the preferred embodiment of the invention.

The rolling unit according to this invention will be described by way of a preferred embodiment referring to the attached drawings. It should be noted here that, in the preferred embodiment described below, rolling units 10 are employed as the sizing mills for finish rolling in the rolling mill shown in FIG. 12. However, the rolling units 10 can suitably be employed in the intermediate line. Each rolling unit 10 has three roll stands 12, 14, 16 arranged serially, with rolls 13, 15, 17 being arranged in such a way that the rotational axes of any downstream roll pair (15 or 17) is offset from those of the adjacent upstream roll pair (13 or 15) by an angle of 90 °, as shown in FIGS. 2 and 3. In this embodiment, the axes of the rolls 13 disposed in the first roll stand 12 located in the upstream position with respect to the direction of rolling a product 20 and those of the rolls 17 in the third roll stand 16 located in the downstream position are set horizontally, and the axes of the rolls 15 disposed in the second roll stand 14 located between the first and second roll stands 12 and 16 are set perpendicularly, as shown in FIG. 7. The rolls 13, 15, 17 in these three roll stands 12, 14, 16 constituting the rolling unit 10 are designed to be driven by one drive motor 18 via a speed reducer 19.

The axis-to-axis distance P between the rolls 13 of the first roll stand 12 and rolls 15 of the second roll stand 14 is set to be not more than 1.2 times the diameter R of the roll 13 (15, 17). The product 20 can be guided accurately and fed to the roll pass of the roll stand 14 by thus shortening the axis-to-axis distance P between the adjacent rolls 13 and the rolls 15, without employing any guide means for guiding the product 20 between these two roll stands 12, 14. If a mechanism to be described later is employed for adjusting the parting between the opposing roll pairs 13, 15 or 17 in the roll stands 12, 14 or 16, the axis-to-axis distance P between the rolls 13 and the rolls 15 still can be kept within the above noted range of not more than 1.2 times the roll diameter R.

Figure 1:
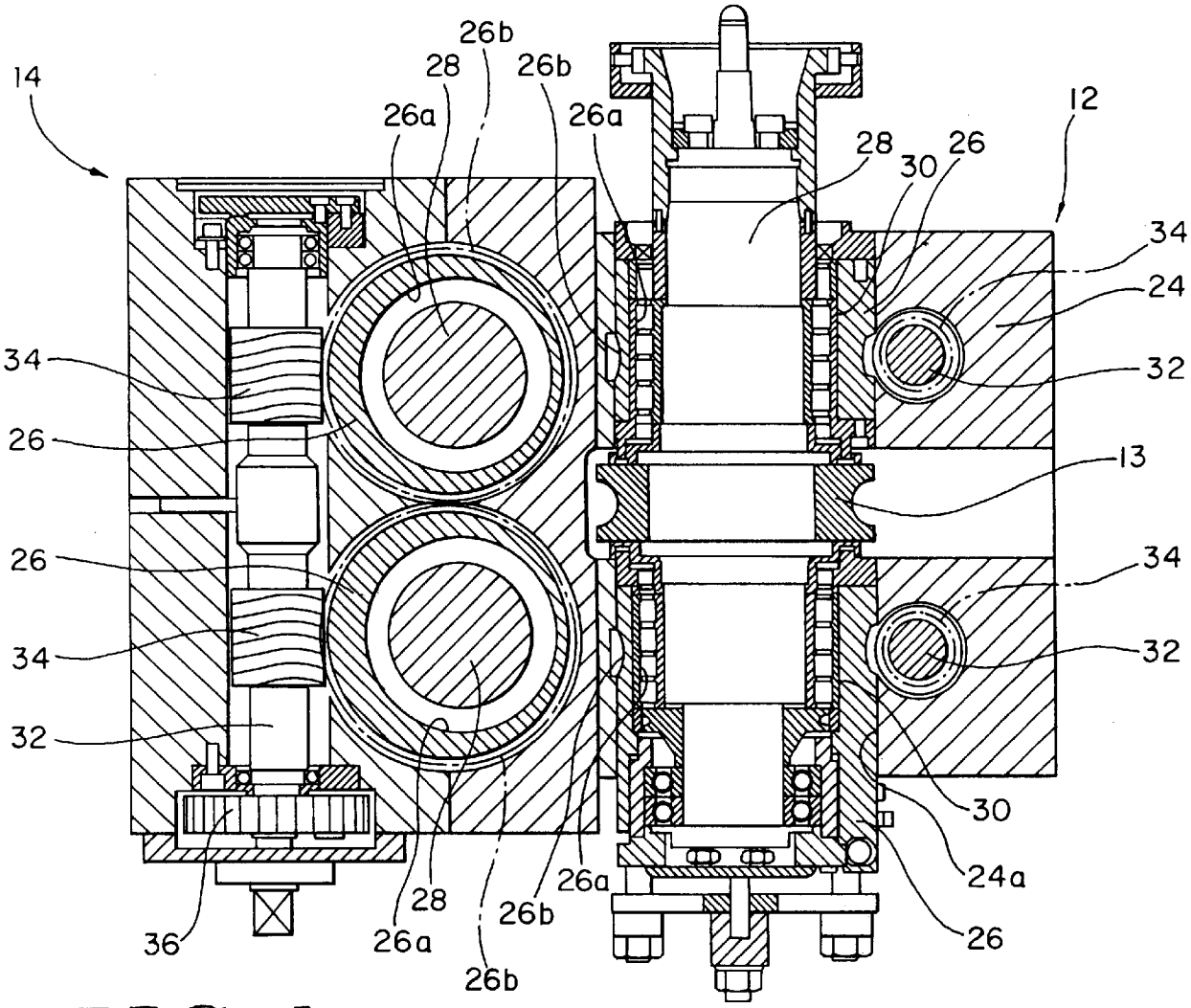
FIG. 1 shows in horizontal cross-sectional view the major portion of a rolling unit according to a preferred embodiment of the invention.

FIG. 1 shows in horizontal cross-sectional view a first roll stand 12 and a second roll stand 14 in the rolling unit 10. Since the structure of the first roll stand 12, that of the second roll stand 14 and that of the third roll stand 16 are substantially the same except that they are arranged side by side in such a way that the rotational axes of the rolls 15 may be offset by 90° from those of the other rolls 13, 17, only the structure of the first roll stand 12 will be described, and a detailed description of the second and third roll stands 14, 16 will be omitted. The components of the second roll stand 14 and the third roll stand 16 corresponding to the components of the first roll stand 12 are identified by the same reference numbers, respectively.

Figure 4:
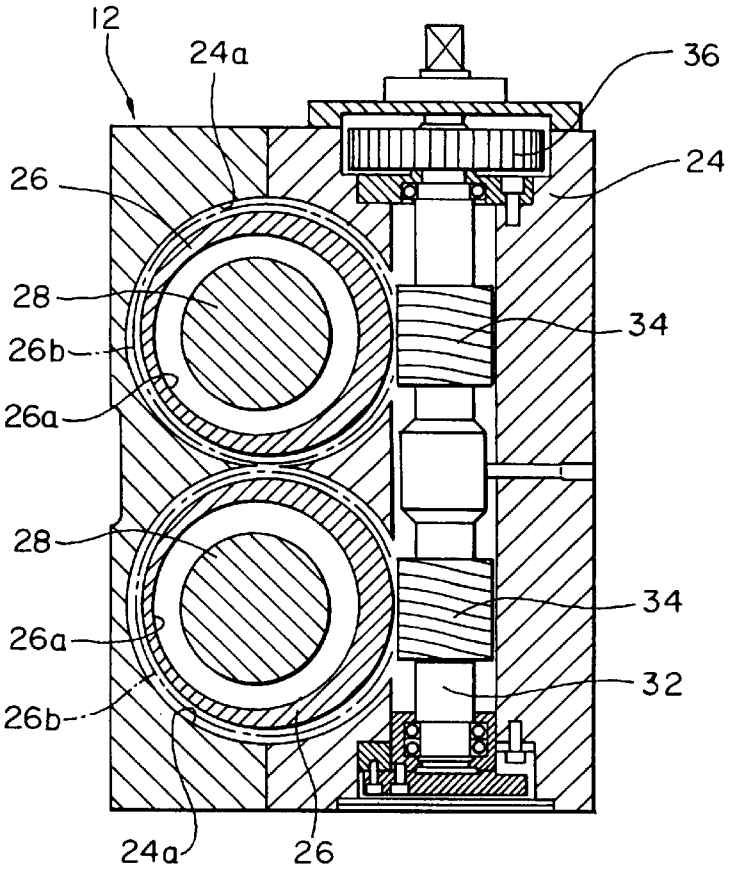
FIG. 4 shows a vertical cross-sectional view of a first roll stand in the rolling unit.
Figure 5:
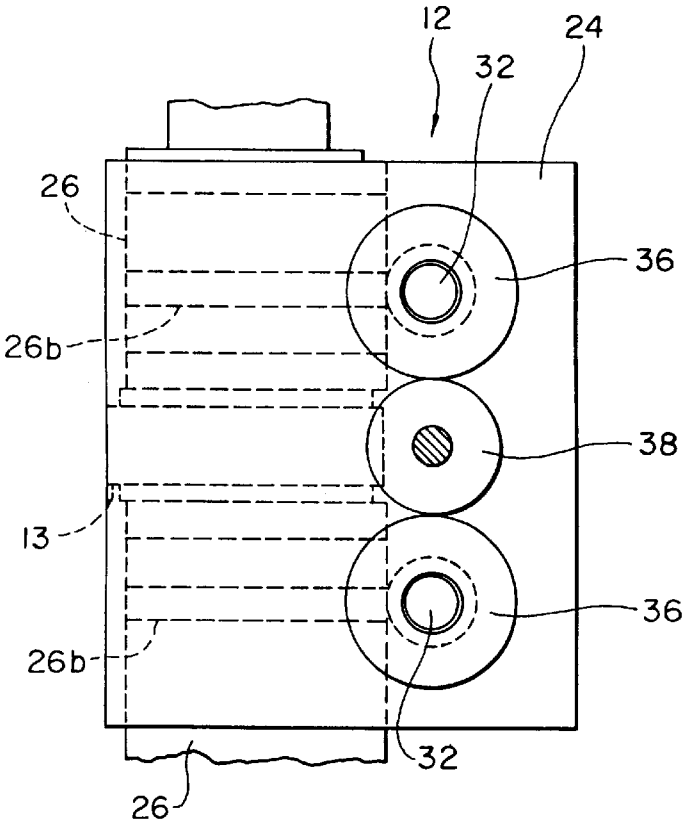
FIG. 5 shows schematically a plan view of the first roll stand in the rolling unit.
Figure 6:
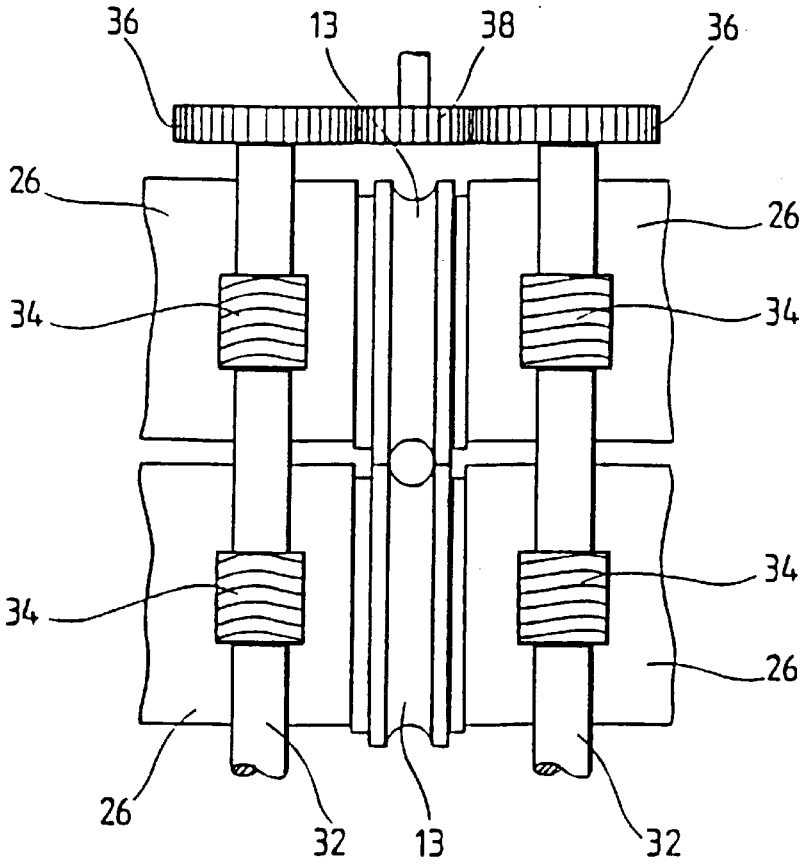
FIG. 6 shows schematically an explanatory view of a roll parting adjustment mechanism in the first roll stand.

A pair of openings 24*a* are defined in each housing 24. The housings are disposed on a bed plate 22 of the rolling unit 10 as shown in FIG. 2. The openings 24*a* are positioned closer to the downstream end of the housing 24 above and below the pass line PL along which the product 20 is fed. The openings 24*a* are perpendicular to the pass line PL, as shown in FIG. 4. As shown in FIG. 1, a pair of eccentric members 26 are rotatably supported in the openings 24*a* respectively, and an eccentric opening 26*a* is defined in each eccentric member 26 such that the axis of the eccentric opening 26*a* is offset from that of the corresponding opening 24*a*. A pair of roll shafts 28 extend through and are rotatably supported in these eccentric openings 26*a* via bearings 30. The pair of rolls 13 are fitted on these roll shafts 28 for rotation therewith. As clearly shown in FIG. 9, each roll shaft 28 is set such that the axis $C_1$ thereof is laterally offset from the axis $C_2$ of the corresponding eccentric member 26, when the roll shaft 28 is inserted through the eccentric opening 26*a* of the eccentric member 26 and that the axis $C_1$ of the roll shaft 28 may be shifted by rotating the eccentric member 26 in clockwise or counterclockwise direction by a mechanism to be described later.

A pair of adjusting shafts 32 intersecting with the roll shafts 28 are rotatably supported in upstream portions of the housing 24 so as to intersect the eccentric members 26. Worms 34 are fitted on each adjusting shaft 32 to be rotatable integrally therewith at the positions intersecting the respective eccentric members 26. Each worm 34 is designed to engage with a toothed portion 26*b* formed on the circumference of the corresponding eccentric member 26. The two worms 34 disposed on each adjusting shaft 32 are of opposite hand; whereas the two worms 34 engaging the eccentric members 26 which are fitted on the same roll shaft 28 are of the same hand. A gear 36 is fitted on one end portion of each adjusting shaft 32 to be rotatable integrally therewith. The gears 36 fitted to the respective adjusting shafts 32 are rotated in the same direction by rotating the adjusting gear 38 in the clockwise or counterclockwise direction by a suitable drive means such as a motor, whereby the corresponding eccentric members 26 are rotated via the respective worms 34. Thus, the axis-to-axis distance between the roll shafts 28 supported by the pair of eccentric members 26 is varied (see FIGS. 9, 11) to adjust the parting between the opposing rolls 13 (see FIGS. 8, 10).

As described above, in the first roll stand 12 employing a roll parting adjustment mechanism utilizing eccentric members 26, the downstream wall of the housing 24 (the side toward which the roll shafts 28 are biased) is designed to be extremely thin, as shown in FIG. 4. Similarly, in the second roll stand 14, the roll shafts 28 are disposed in the housing 24 so as to be biased upstream, as shown in FIG. 1, whereby the upstream wall of the housing 24 is designed to be extremely thin. The first roll stand 12 and the second roll stand 14 are arranged adjacent to each other such that the thin wall sides of their respective housings 24 face each other, whereby the axis-to-axis distance P between the rolls 13 of the first roll stand 12 and the rolls 15 of the second roll stand 14 can be reduced to not more than 1.2 times the diameter R of the rolls 13 (15). The second roll stand 14 and the third roll stand 16 are arranged in such a way that the side of the housing 24 in the second roll stand 14 where the roll parting adjustment mechanism is disposed may oppose to the third roll stand 16, so that the axis-to-axis distance between the rolls 15 and the rolls 17 is greater than 1.2 times the diameter R of the roll 13 but not more than 2R.

Figure 12:
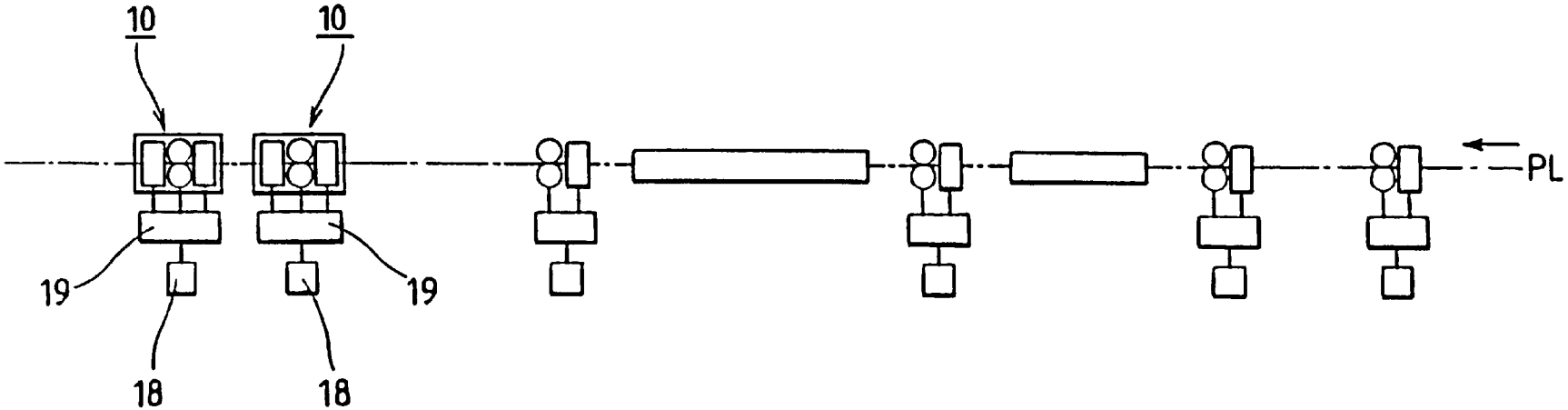
FIG. 12 shows an explanatory view of a mill installation in which several rolling mills are disposed.

In operation, a product 20 having underwent a rolling process in the upstream line of the installation shown in FIG. 12 is fed to the first roll stand 12 of the rolling unit 10, shown in FIG. 2 and passed through the roll pass defined between the opposing rolls 13 of the first roll stand 12 to undergo a predetermined reduction. The thus reduced product 20 is then fed through the roll pass defined by the rolls 15 of the second roll stand 14. Since the first roll stand 12 and the second roll stand 14 are arranged such that the axis-to-axis distance P between the rolls 13 and the rolls 15 is not more than 1.2 times the diameter of the roll 13, the product 20 can accurately be directed to the roll pass of the second roll stand 14 without providing any interstand guiding means as conventionally employed. The rolls 13 in the first roll stand 12 also serve as the guiding means for guiding the product 20 to the second roll stand 14, so that twisting of the product 20 can effectively be prevented. Incidentally, since a very light reduction commonly referred to as a "skin pass" is designed to be effected in the final roll pass in the finish rolling, twisting of the product 20 can be held within a tolerable range, even if the axis-to-axis distance between the rolls 15 in the second roll pass 14 and the rolls 17 in the third roll pass 16 is greater than 1.2 times but not greater than 2 times the roll diameter.

Figure 8:
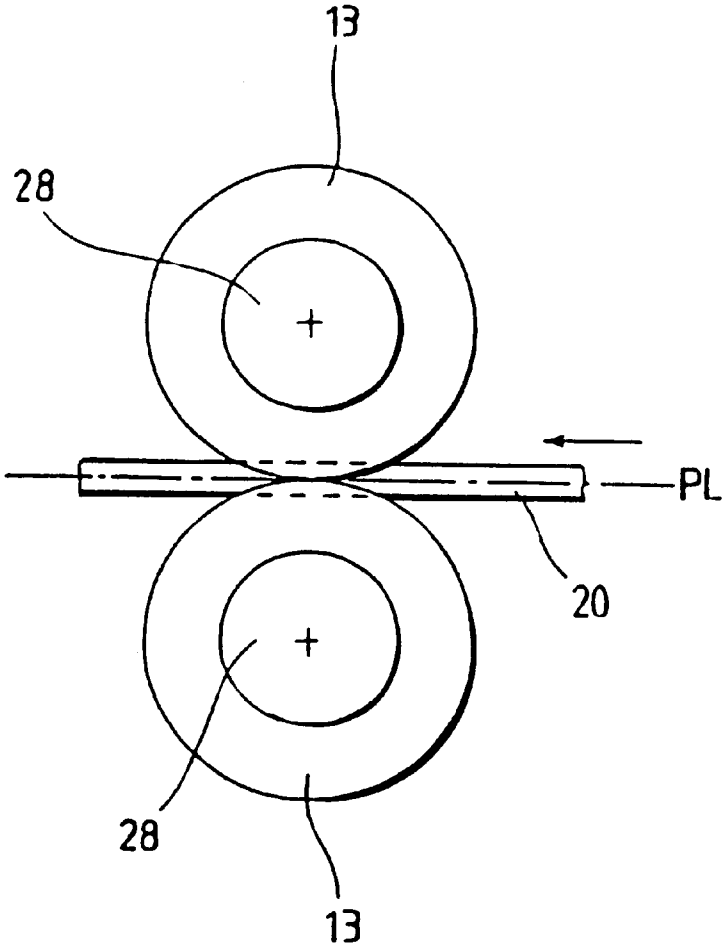
FIG. 8 shows an explanatory view illustrating the relationship between a pair of opposing rolls which are rolling a small-diameter product.
Figure 9:
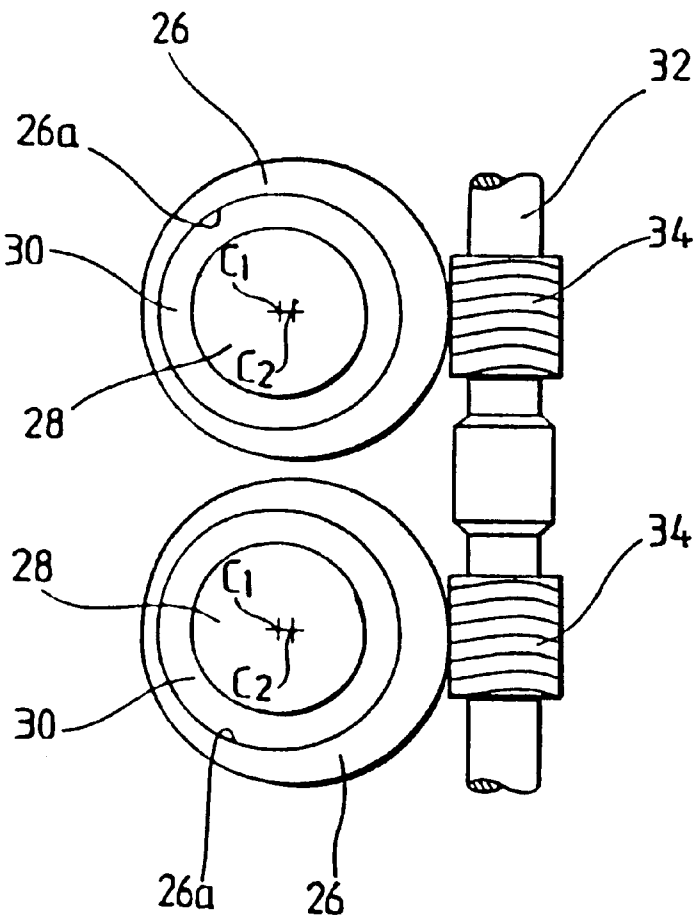
FIG. 9 shows an explanatory view illustrating the relationship between the axes of the rolls assuming the state shown in FIG. 8 and the axis of an eccentric member.

When a small-diameter product 20 is to be rolled, the clearance between the opposing rolls 13 in the first roll pass 12 is set to a predetermined parting, as shown in FIG. 8, and the rolls 13 are rotated in the directions opposite to each other, where the axes $C_1$ of the roll shafts 28 and the axes $C_2$ of the eccentric members 26 are in the relationship as shown in FIG. 9. Accordingly, if the product 20 is fed between the rolls 13 of the first roll stand 12, the product 20 undergoes a predetermined reduction and is then fed to the second roll stand 14.

Figure 10:
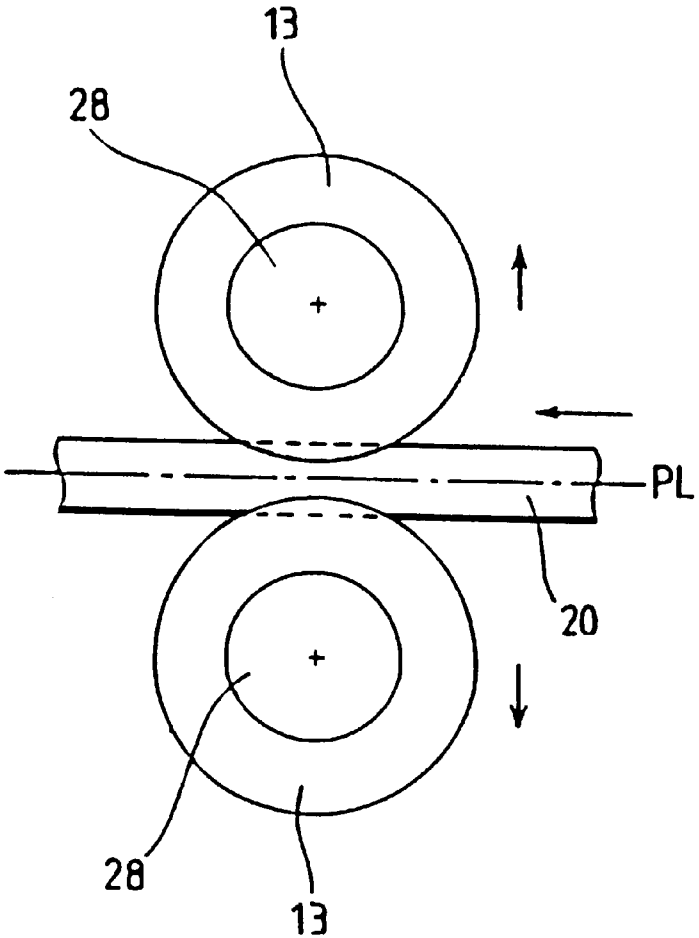
FIG. 10 shows an explanatory view illustrating the relationship between a pair of opposing rolls which are rolling a large-diameter product.
Figure 11:
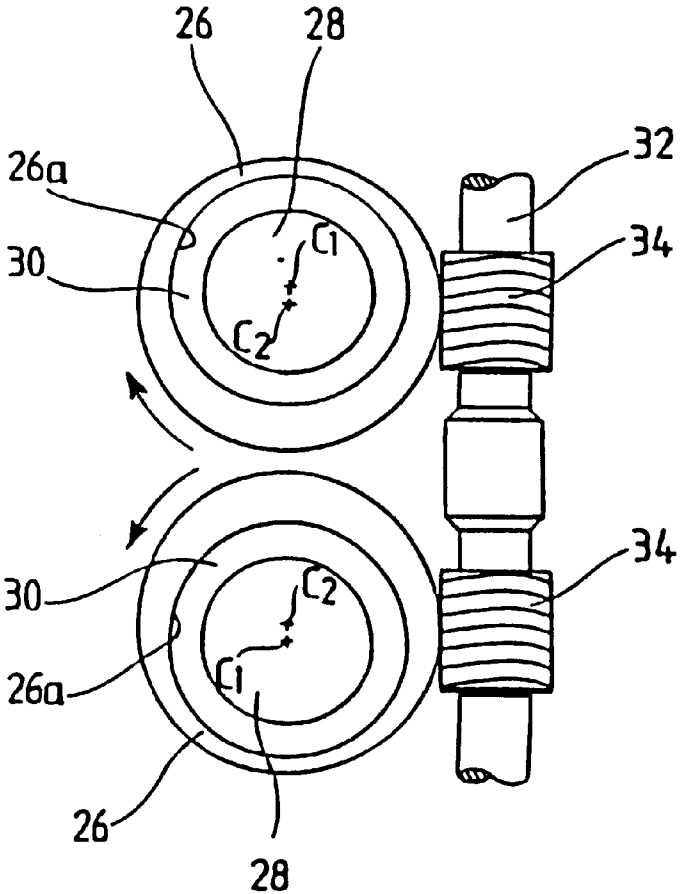
FIG. 11 shows an explanatory view illustrating the relationship between the axes of the rolls assuming the state shown in FIG. 10 and the axis of the eccentric member.

When a larger diameter product 20 is to be rolled in the rolling unit 10 in accordance with an order change, the adjusting gear 38 is rotated in the predetermined direction by a drive means to rotate the adjusting shafts 38 in the same direction. Since the worms 34 disposed on each adjusting shaft 32 are engaged with the toothed portions 26*b* of the corresponding eccentric members 26 fitted on the upper or lower roll shafts 28, the eccentric members 26 can be rotated in the predetermined direction in the openings 24*a* defined through the housing 24 as the corresponding adjusting shaft 32 rotates. The upper eccentric member 26 and the lower eccentric member 26 rotate in opposite directions to change the distance between the axes $C_1$ of the roll shafts 28 supported by the eccentric members 26, as shown in FIG. 11. Thus, the parting between the opposing rolls 13 fitted on the roll shafts 28, respectively, is increased, as shown in FIG. 10. When the parting between the rolls 13 reaches the preset level depending on the size of the product 20, the rotation of the adjust gear 38 is stopped to complete the parting adjustment.

It will be understood that a number of variations of the arrangement of the rolls of the respective roll stands in the rolling unit can be assumed other than the illustrated embodiment. For example, the axes of the rolls 13 of the first roll stand 12 and those of the rolls 17 in the third roll stand 16 may be perpendicular, and the axes of the rolls 15 in the second roll stand 14 may be horizontal. Further, in the preferred embodiment described above, the rolling unit consists of three roll stands. However, the rolling unit may of course consist of only two roll stands. Further, the roll stands in the rolling unit may respectively be driven by independent drive motors.

It will be apparent to those skilled in the art that the present invention may be embodied in may other specific forms without departing from the spirit or scope of the invention. Therefore, the present embodiment is to be considered as illustrative and not restrictive and the invention is not to be limited to the details given herein, but may be modified within the scope of the appended claims.

What is claimed is:

1. A rolling unit comprising at least two roll stands arranged along a rolling line, each roll stand having a pair work rolls carried on roll shafts, the roll shafts being journalled for rotation in eccentric sleeves which in turn are journalled for rotation in a housing, the rotational axes of the eccentric sleeves being spaced from opposite first and second sides of the housing by first and second housing portions, the width of the first housing portion measured in the direction of the rolling line being less than the width of the second housing portion measured in the same direction, means in the second housing portion for rotatably adjusting the eccentric sleeves simultaneously in order to vary the spacing between the work rolls, the housings of the roll stands being arranged such that the axes of the work rolls of one roll stand are offset by 90° with the respect to the axes of the work rolls of the other roll stand, with the first sides of the housings being arranged in a confronting relationship.

* * * * *